US005497922A

United States Patent [19]

Tate

[11] Patent Number: 5,497,922

[45] Date of Patent: Mar. 12, 1996

[54] COUNTER BALANCE POCKETS WITH FRAME FOR BACKPACKS

[75] Inventor: Aarn Tate, Fairfield, Iowa

[73] Assignee: The Natural Balance Design Co., Fairfield, Iowa

[21] Appl. No.: 248,731

[22] Filed: May 25, 1994

[51] Int. Cl.[6] ..... A45F 3/04

[52] U.S. Cl. ..... 224/209; 224/191; 224/202; 224/204; 224/211; 224/212; 224/215; 224/216; 224/259; 224/160

[58] Field of Search ..... 224/191, 202, 224/204, 209–216, 223, 224, 259, 260, 160, 161, 225, 226, 228, 229, 901; 128/201.27, 202.14, 205.22; 441/114–118; D3/216, 217, 224

[56] References Cited

U.S. PATENT DOCUMENTS

| | | | |
|---|---|---|---|
| 3,135,098 | 6/1964 | Root | 61/70 |
| 4,087,031 | 2/1978 | Fenner | 224/25 A |
| 4,217,998 | 10/1980 | Alexander | 224/261 |
| 4,694,772 | 9/1987 | Faulconer et al. | 114/315 |
| 5,161,722 | 11/1992 | Hembree | 224/262 |
| 5,289,959 | 3/1994 | Beeley et al. | 224/160 |

FOREIGN PATENT DOCUMENTS

| | | |
|---|---|---|
| 2387002 | 6/1978 | France . |
| 9316616 | 9/1993 | WIPO . |

*Primary Examiner*—Henry J. Recla
*Assistant Examiner*—Timothy L. Maust
*Attorney, Agent, or Firm*—Charles Bruzga

[57] ABSTRACT

Disclosed is a backpack and counter-balance system. The system comprises a backpack having a pair of shoulder straps and a hip suspension system for supporting the weight of the backpack on the user's shoulders and hips respectively. At least one pocket system is worn in front of a user for counter-balancing backpack weight located rearwardly of the user. Each pocket system comprises at least one pocket, and a lower connection region for connection to the hip suspension system. The pocket system is supported in general vertical alignment above the lower connection region so as to transfer at least a majority, of the weight of the pocket system to the lower connection region. The pocket system further includes a connector for securing an upper connection region of the pocket system so as to maintain the general vertical alignment of the pocket system.

20 Claims, 5 Drawing Sheets

COUNTER BALANCE POCKETS WITH FRAME FOR BACKPACKS

BACKGROUND AND SUMMARY OF THE INVENTION

The present invention relates to an improved method of counter-balancing the weight of a backpack. Specifically, backpacks require the wearer to lean forward to maintain his or her balance. This posture can be uncomfortable, because it puts strain on the back and shoulder muscles. In addition, one's sense of balance is not as good when leaning forward with a heavy load as it is standing straight.

The invention provides front pockets attached first to either the backpack near the top or the shoulder straps, and second to the front of the hip belt or other hip suspension system of the backpack. When loaded with heavy items, the front pockets counter-balance the weight of the pack to some extent so that the pack wearer will automatically stand up straighter. Putting some of the weight in front of the wearer moves the center of gravity of the load forward. By putting the heavier items in the front pockets and lighter items in the backpack, the center of gravity of the entire load can be balanced at about the same point as the wearer's own center of gravity despite there being larger capacity in the backpack. The wearer can then stand in his or her normal upright posture, and maintain a normal sense of balance.

Other attempts to counter-balance the pack weight include hanging a small pack, pouches or ammunition from the shoulder straps. "Front pouches" hanging from the shoulder straps on the wearer's front are described in U.S. Pat. No. 4,087,031. These methods all succeed in counter-balancing the backpack to some extent, but they have other drawbacks. The main draw-back is that any load that is worn in front, or put into front pouches as shown in U.S. Pat. No. 4,087,031, will be born by the shoulder straps which puts the weight of the contents of the front worn pouches on the shoulders. This undermines another desirable feature of modern backpacks which is that a large portion of the load is transferred to the hips via a hip belt or hip suspension system in order to reduce the weight on the shoulders as much as possible. The current invention resolves this problem by transferring at least a majority of the weight of the articles in the front pockets to the hip suspension system, not the shoulder straps.

Backpack counter-balancing frame extensions over and around the wearer's head are described in different forms in U.S. Pat. Nos. 5,161,722 and 4,087,031. However, these put additional weight high up relative to the wearer's center of gravity, which makes the pack easily tipped when the wearer leans in any direction. Rugged terrain and active sports like climbing, mountaineering and skiing often require the pack wearer to lean without being overbalanced by his or her pack.

A method to tilt a backpack load forward is described in U.S. Pat. No. 4,217,998, but this does not adequately counter-balance the load so that the wearer can stand in a normal posture. It also does not add capacity for carrying additional gear which the current invention does.

It is an object of the invention to provide an improved backpack counter-balancing system. It is also an objective of the invention to simultaneously remove weight from the shoulders so as to transfer that weight to the hips via a frame in the counter-balance system which is at least semi-rigid where it can be born by the pelvis which is the strongest bone in the human body. It is a further objective of the invention to provide a system for counter-balancing backpacks that does not interfere with the vision of the wearer either to see ahead or to see his or her feet. It is also an objective of the invention to provide such a system which has large capacity so that enough weight can be fitted into it to completely counter-balance the backpack. It is also an objective of the invention to provide a counter-balancing system that is steady, and does not roll or slap the body of the wearer when he or she is hiking. It is also an objective of the invention to provide such a system that is detachable from the backpack is comfortable to the wearer and does not interfere with normal arm movements while walking. Another objective is to provide a counter-balancing system that also provides easy access to often needed articles while hiking such as a camera, water bottle, maps, field glasses, etc. Yet another objective is to provide such a system which also performs multiple functions including that it can alternatively be worn about the waist as a waist pack, clipped onto the body of the backpack to be used as extra pockets on the backpack itself, or clipped together and worn on the back like a small backpack with shoulder straps. Other objectives will be apparent from the specification and the recital of claims.

In accordance with one form of the invention, there is provided a backpack and counter-balance system. The system comprises a backpack having a pair of shoulder straps and a hip suspension system for supporting the weight of the backpack on the shoulders and hips of the user, respectively. At least one pocket system is worn in front of a user for counter-balancing backpack weight located rearwardly of the user. Each pocket system comprises at least one pocket, and a lower connection region for connection to the hip suspension system. The pocket system is supported in general vertical alignment above the lower connection region so as to transfer at least a majority of the weight of the pocket system to the lower connection region. The pocket system further includes means for securing an upper connection region of the pocket system so as to maintain the general vertical alignment of the pocket system.

BRIEF DESCRIPTION OF DRAWINGS

The forgoing, and further, objects and advantages of the invention will become apparent from the following description when read in conjunction with the accompanying drawing figures, in which.

DETAILED DESCRIPTION OF THE INVENTION

Figure 1A:
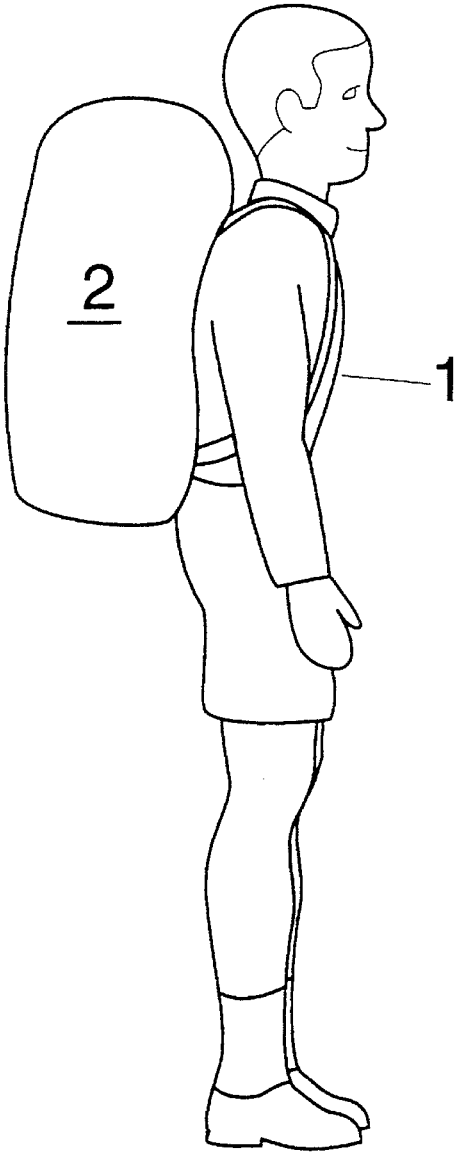
FIG. 1. is an elevation view of a backpacker showing the effect on his posture of backpacks 1A.) without front pockets and 1B.) with front pockets.
Figure 1B:
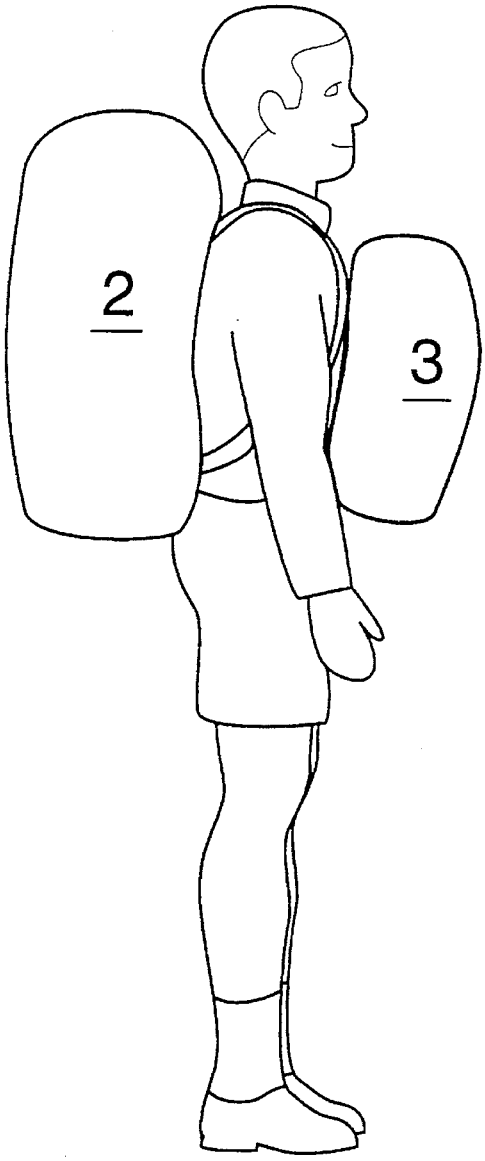

FIG. 1A. shows how a backpack user 1 must lean forward to counter-balance a backpack 2 to prevent being pulled off balance and falling over in the backward direction. FIG. 1B. shows how the pockets 3 are worn in front of the user, counter-balancing the backpack, so the user maintains a natural upright posture without being pulled off balance by the weight of the backpack.

Figure 2:
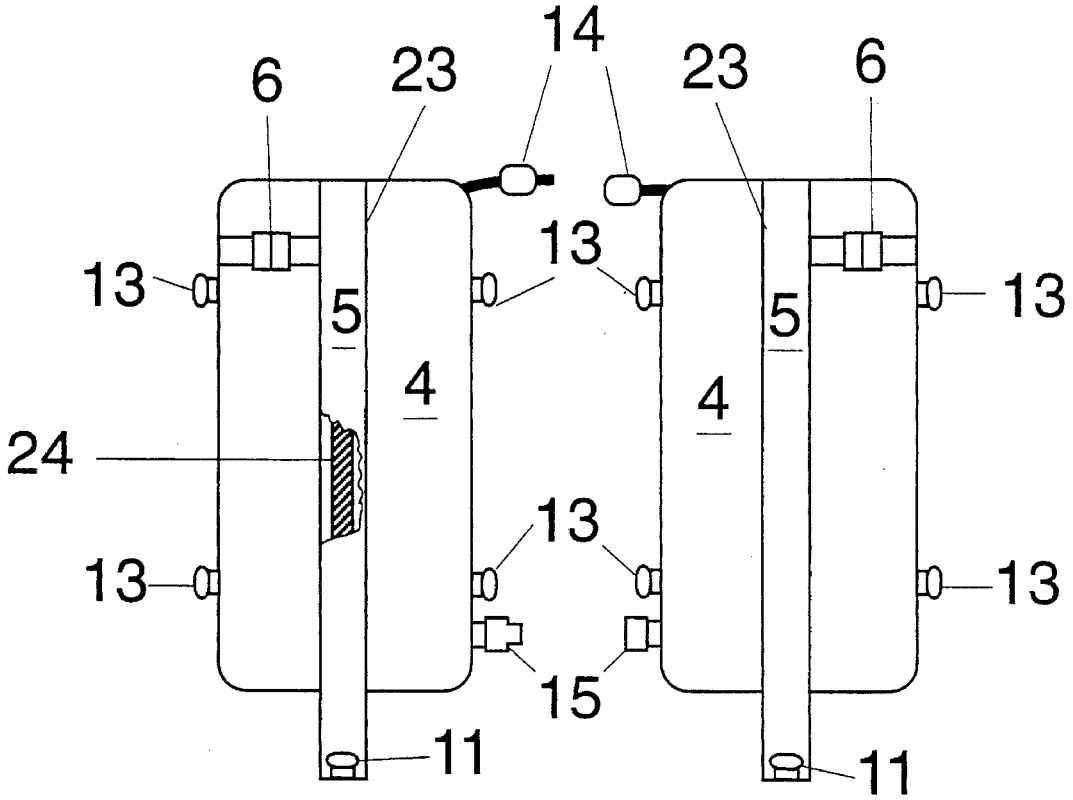
FIG. 2 is an elevation view, partially cut away, showing the pocket system from the back.

FIG. 2 is an elevation view showing the pocket system from the back. The pockets 4 each have a fabric sleeve 5 running the length of the pocket and extending beyond the bottom of the pocket. The sleeve contains a removable semi-rigid frame 24 and which is bendable to match the contour of the wearer's body. The frame material can be aluminum or titanium tube, or bar or any material which is strong enough to support the weight of the contents of the pocket(s) without bending, but which is pliable enough to be bent by the application of force to match the shape of the wearer's body.

A clip 6 near the top of each pocket on the back fastens around the strap 7 (FIG. 7), on the shoulder strap pad of the backpack. Quick release clips which are common on backpacks may be used to attach the pocket system to the backpack shoulder strap, or any clip which can fasten around a strap may also be used. The strap 7 is preferably attached to the shoulder pad 19 at the lower end of the padding 8 and at a point approximately half way along the shoulder strap padding 9. Attachment is most commonly accomplished by sewing the strap 7 to the padding at these two points. The clip 6 is free to slide dynamically along the strap between these two points 8, 9. Therefore no weight is hung on the shoulder strap by the front pocket when it is in position 10, because the clip slides down the strap to the point where it is supported by the frame 24 in the pocket sleeve 5 which is in turn supported by the hip suspension system at point 12. The ability of the clip 6 to slide up and down the shoulder strap 7 gives the wearer freedom of movement to bend forward or lift one or the other hip bone several inches without resistance from the shoulder strap when the pocket is raised or lowered relative to the wearer's shoulders.

Figure 6:
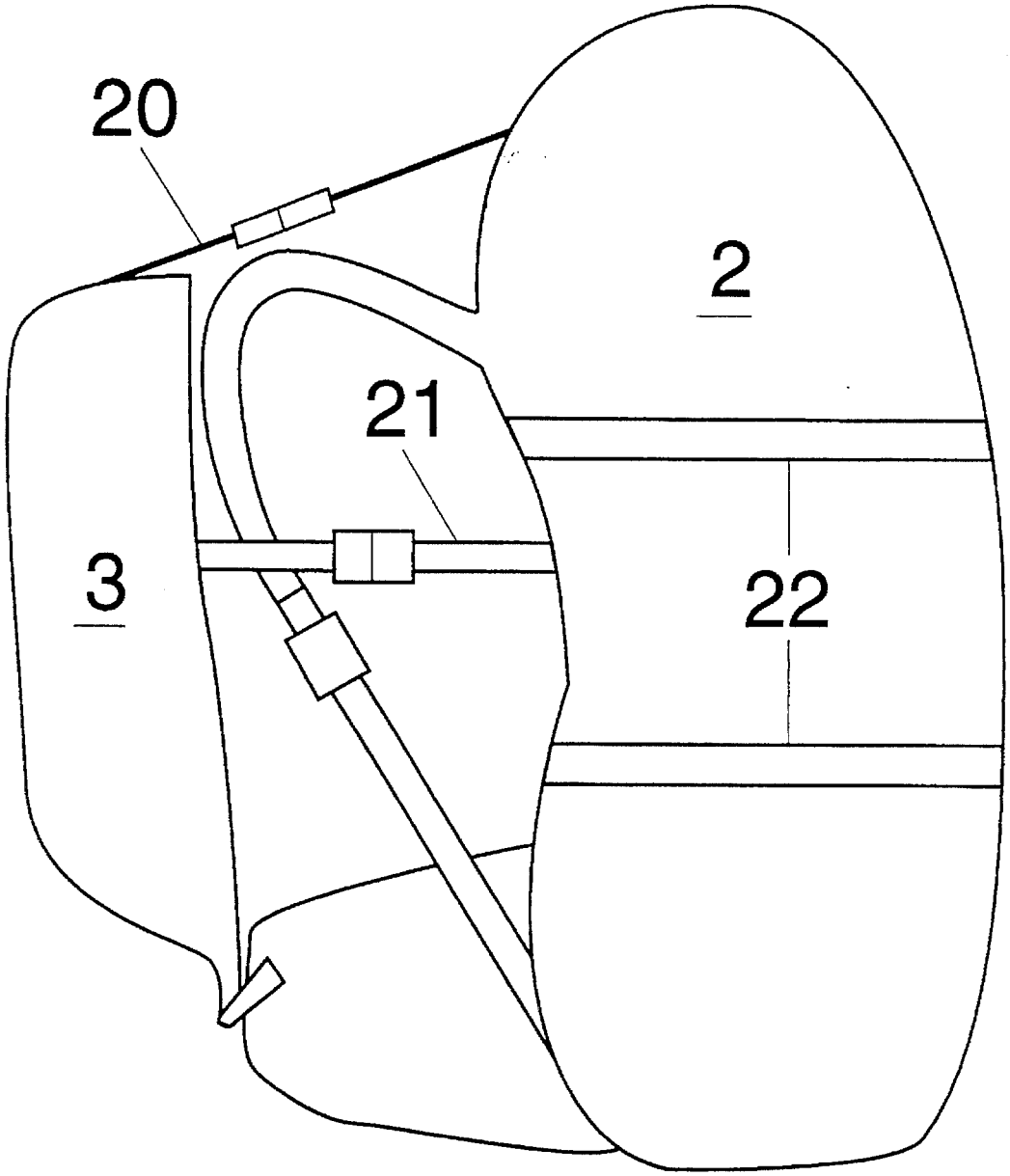
FIG. 6 is an elevation view from the side showing the pockets attaching directly to the backpack instead of the shoulder straps.

FIG. 6 shows alternate methods of attaching the top of the pockets to the backpack directly rather than the shoulder straps. The top of the pocket(s) 3 may be attached to the backpack either by means of a strap 20 running over the shoulder straps to the top of the backpack 2 or, alternatively, a strap 21 under the arms of the wearer to the sides of the backpack.

Figure 7:
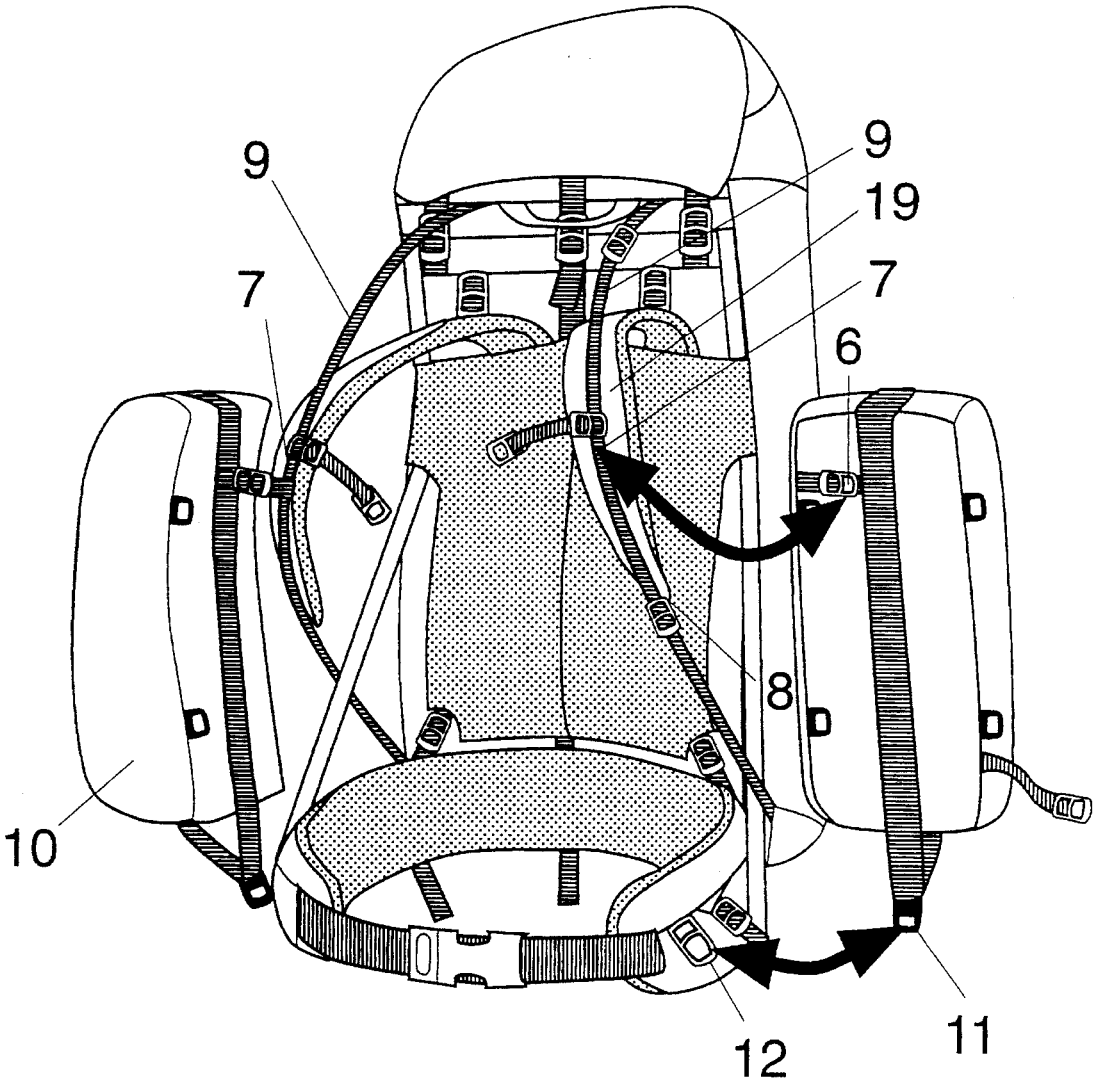
FIG. 7 is a perspective view showing the pockets attaching to the backpack in front of the wearer.

FIG. 2 also shows that on the bottom end of each of the pocket sleeves 5 is an oval metal "slider" 11 which attaches to "D" rings (metal or plastic rings in the shape of the letter "D") 12 near the ends of the hip suspension system of the backpack in FIG. 7. Any type of clip may be used to attach the pockets to the hip suspension system, including the oval metal sliders in conjunction with "D" rings as shown which are common on backpacks.

In some situations where a cliff face or other obstacle is close to the wearer's chest the pockets can be unclipped from in front of the wearer and re-clipped to the sides of the pack. FIG. 2 shows that each pocket has four sliders or clips 13 on the sides. These are used to attach the pockets to the sides of the body of the backpack, which may be equipped with "D" rings or webs 22 in FIG. 6 that can be fed through the sliders when they are being used as side pockets on the pack, and not being worn as front pockets.

FIG. 2 also shows that there are 2 sets of clips 14, 15 which connect the pockets to each other to prevent the pockets from rolling or slapping against the wearer's body while walking when worn in the front position. The clips are on straps of adjustable length so that the distance between the pockets can be adjusted to give the wearer a view of his or her feet through the gap between the pockets. Quick release clips may be used.

Figure 3:
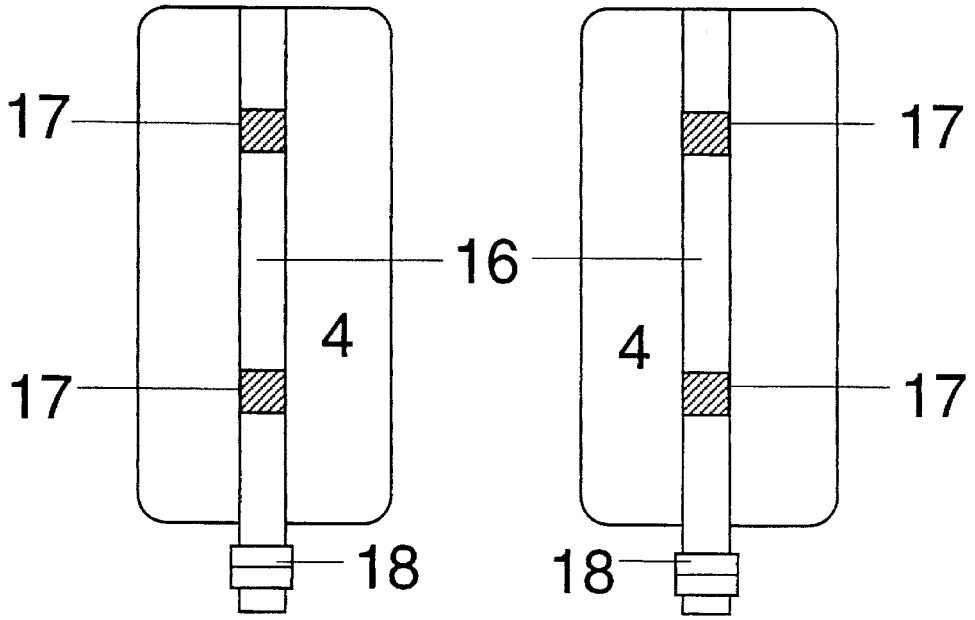
FIG. 3 is an elevation view showing the pocket system from the front.
Figure 4:
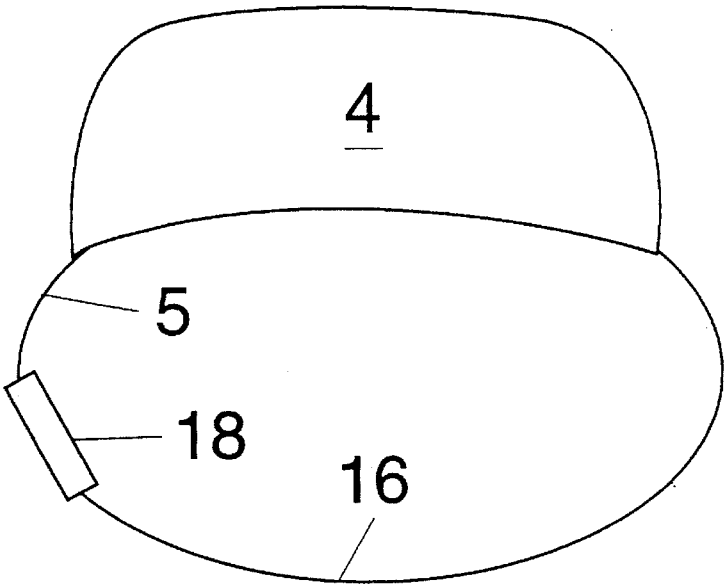
FIG. 4 is a plan view of one pocket used as a waist pack.

FIG. 3 shows an elevation view of the front of the pockets. A strap 16 running the length of the pocket slides through guides 17, and is adjustable via a buckle 18 at the bottom. The buckle may be a quick release buckle or clip, and the guides may be made from velcro or quick release clips to permit removal of the strap. Tightening the strap 16 after the pocket is loaded prevents the load from shifting inside the pocket. In addition, the buckle can release the strap entirely. The strap can be removed from the guides and the buckle can be reconnected on the opposite side of the pocket, the back side, and around the wearer's waist as shown in FIG. 4. The pocket can then be worn as a hip pack. The frame 24 can be removed from the sleeve 5 via an opening on the side of the sleeve 5 near the top 23 to allow said pocket and sleeve to curve around the wearer's waist comfortably. The opening 23 (FIG. 2) in the sleeve 5 may be held closed when the frame 24 is in the sleeve 5 by velcro across or over the opening.

Figure 5:
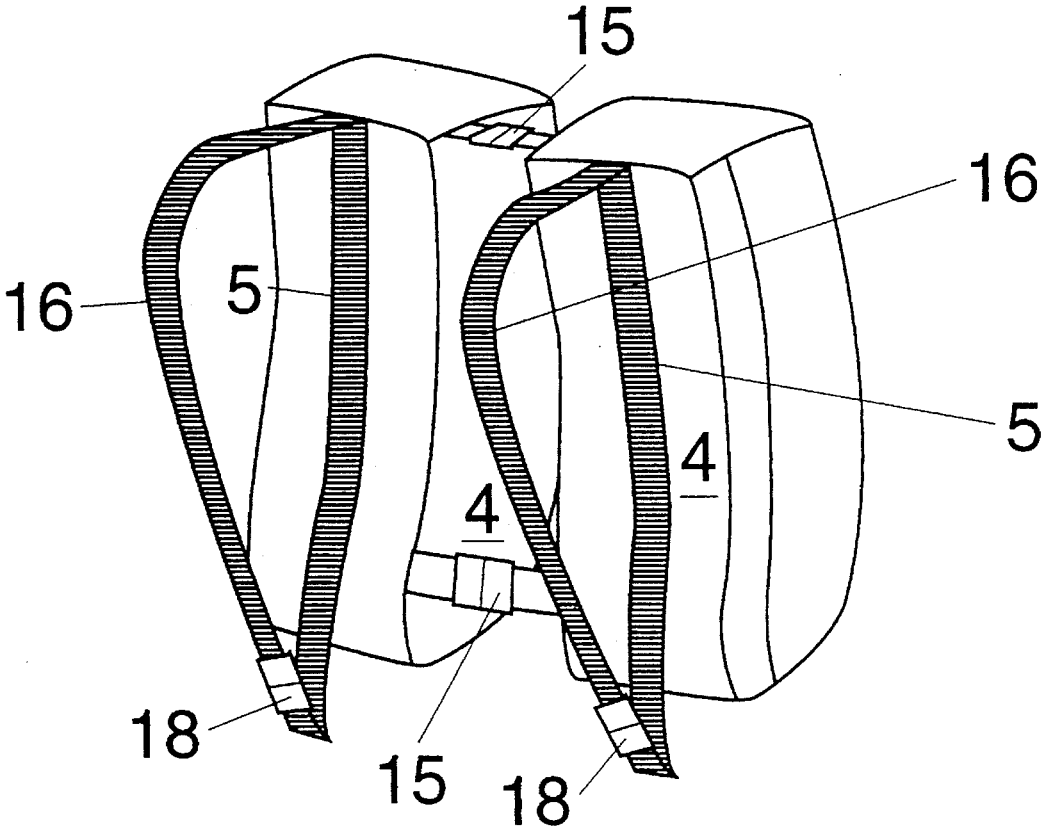
FIG. 5 is a perspective view of the pockets connected and used as a small two compartment backpack.

Said pockets can also remain connected with clips 14 and 15, and the pockets can be worn as a small backpack using the straps 16 as shoulder straps as shown in FIG. 5.

It should be apparent that many modifications could be made to the front pocket system which would still be encompassed within the spirit of the present invention. It is intended that all such modification may fall within the scope of the appended claims.

What is claimed is:

1. A backpack and counter-balance system, comprising:

(a) a backpack having a pair of shoulder straps and hip suspension system for supporting the weight of the backpack on the shoulders and hips of a user, respectively;

(b) at least one pocket system that is worn in front of the user, which system, together with any contents thereof, counter-balances in a non-aqueous environment the weight of said backpack and the weight of any contents thereof located rearward of the user; each said pocket system comprising:

(i) at least one pocket;

(ii) a lower connection region for connection to said hip suspension system;

(iii) said pocket system being supported in general vertical alignment above said lower connection region by a frame which is at least semi-rigid such that said frame is bendable to match the shape of the user's body and formed of substantially solid material and on which the weight of said pocket system together with any contents thereof rests so as to support at least a majority of the weight of said pocket system together with any contents thereof on said hip suspension system, said frame having one end connected to said shoulder straps and an opposite end connected to said hip suspension system; and (c) means for securing an upper connection region of said pocket system so as to maintain said general vertical alignment of said pocket system.

2. The backpack and counter-balance system of claim 1, including a pair of pocket systems as above defined, one for being worn on the right side of a user, and one for being worn on the left side of a chest of a user.

3. The backpack and counter-balance system of claim 2, wherein said pair of pocket systems further comprise:

(a) a means for connection directly to each other when said pocket systems are worn in front of the user; and (b) a space between the pockets through which the user can see downward, between said pockets.

4. The backpack and counter-balance system as of claim 1, wherein:

(a) said pocket system is detachable from the backpack for being worn independently as a separate unit on the back of the user; and (b) said pocket system comprises means for securing said pocket system to a shoulder of a user.

5. The backpack and counter-balance system of claim 1, wherein said means for securing an upper region of said pocket system comprises a loop around an associated strap which is attached to the backpack; said loop being loose enough so that said pocket system is slideable up and down the strap.

6. The backpack and counter-balance system of claim 1, wherein said means for securing an upper region of said pocket system comprises a means for securing said upper region directly to said backpack without causing said majority of the weight of said pocket system together with any contents thereof to bear on the shoulder of the wearer.

7. The backpack and counter-balance system of claim 1, wherein said frame is bendable to match the shape of the user's body.

8. The backpack and counter-balance system of claim 7, wherein:

(a) said frame is removable; and (b) said pocket system is detachable; and (c) said pocket system comprises respective means located at first and second ends of said pocket system for securing said pocket system around a user's waist independently of the backpack when said pocket system is tipped on its side and worn horizontally with first and second ends at the same height at about the user's waist.

9. A backpack and counterbalance system, comprising:

(a) a backpack having a pair of shoulder straps and hip suspension system for non-aquatic use supporting the weight of the backpack on the shoulders and hips of a user, respectively;

(b) at least one pocket system that is worn in front of the user, which system, together with any contents thereof, counter-balances in a non-aqueous environment the weight of said backpack and the weight of any contents thereof located rearward of the user; each said pocket system comprising:

(i) at least one pocket;

(ii) a lower connection region for connection to said hip suspension system;

(iii) said pocket system being supported in general vertical alignment above said lower connection region by a frame which is at least semi-rigid such that said frame is bendable to match the shape of the user's body and formed of substantially solid material and on which the weight of said pocket system together with any contents thereof rests so as to support substantially all of the weight of said pocket system together with any contents thereof on said hip suspension system; said frame having one end connected to said shoulder straps and an opposite end connected to said hip suspension system; and (c) means for securing an upper connection region of said pocket system so as to maintain said general vertical alignment of said pocket system.

10. The backpack and counter-balance system in claim 9, including a pair of pocket systems as above defined, one for being worn on the right side of a user's chest, and one for being worn on the left side of a chest of a user.

11. The backpack and counter-balance system of claim 10, wherein said pair of pocket systems further comprise:

(a) a means for connection directly to each other when said pocket systems are worn in front of the user; and (b) a space between the pockets through which the user can see downward, between said pockets.

12. The backpack and counter-balance system as in claim 9, wherein:

(a) said pocket system is detachable from the backpack for being worn independently as a separate unit on the back of the user; and (b) said pocket system comprises means for securing said pocket system to a shoulder of a user.

13. The backpack and counter-balance system of claim 9, wherein said means for securing an upper region of said pocket system comprises a loop around an associated strap which is attached to the backpack; said loop being loose enough so that said pocket system is slideable up and down the strap.

14. The backpack and counter-balance system of claim 9, wherein said means for securing an upper region of said pocket system comprises a means for securing said upper region directly to said backpack without causing said majority of the weight of said pocket system together with any contents thereof to bear on the shoulder of the wearer.

15. The backpack and counter-balance system of claim 9, wherein said frame is bendable to match the shape of the user's body.

16. The backpack and counter-balance system of claim 15, wherein:

(a) said frame is removable; and (b) said pocket system is detachable; and (c) said pocket system comprises respective means located at first and second ends of said pocket system for securing said pocket system around a user's waist independently of the backpack when said pocket system is tipped and worn horizontally with first and second ends at the same height at the user's waist.

17. A counter-balance system for a backpack, said backpack including a pair of shoulder straps and a hip suspension system for supporting the weight of the backpack on the shoulders and hips of a user, respectively, said counter-balance system comprising:

(a) at least one pocket system that is worn in front of the user, which system, together with any contents thereof, counter-balances in a non-aqueous environment the weight of said backpack and the weight of any contents thereof located rearward of the user; each said pocket system comprising:

(i) at least one pocket;

(ii) a lower connection region for connection to said hip suspension system;

(iii) said pocket system being supported in general vertical alignment above said lower connection region by a frame which is at least semi-rigid such that said frame is bendable to match the shape of the user's body and formed of substantially solid material and on which the weight of said pocket system together with any contents thereof rests so as to support at least a majority of the weight of said pocket system together with any contents thereof on said hip suspension system, said frame having one end connected to said shoulder straps and an opposite end connected to said hip suspension system; and (b) means for securing an upper connection region of said pocket system so as to maintain said general vertical alignment of said pocket system.

18. The counter-balance system of claim 17, including a pair of pocket systems as defined above, one for being worn on the right side of a chest of a user, and one for being worn on the left side of a user; said pair of pocket systems further comprising:

(a) a means for connection directly to each other when said pocket systems are worn in front of the user; and (b) a space between the pockets through which the user can see downward between said pockets.

19. The counter-balance system of claim 17, wherein said means for securing an upper region of said pocket system comprises a loop around an associated strap which is attached to the backpack; said loop being loose enough so that said pocket system is slideable up and down the strap.

20. The counter-balance system of claim 17, wherein said frame is bendable to match the shape of the user's body.

* * * * *